US006394919B1

(12) United States Patent
Ossege

(10) Patent No.: US 6,394,919 B1
(45) Date of Patent: May 28, 2002

(54) ARROW FOR A CROSSBOW OR BOW

(76) Inventor: Johannes Ossege, Am Riesweg 7, Bad Iburg (DE)

( * ) Notice: Subject to any disclaimer, the term of this patent is extended or adjusted under 35 U.S.C. 154(b) by 0 days.

(21) Appl. No.: 09/632,849

(22) Filed: Aug. 4, 2000

Related U.S. Application Data

(62) Division of application No. 09/372,987, filed on Aug. 12, 1999, now Pat. No. 6,203,456.

(30) Foreign Application Priority Data

Oct. 15, 1998 (DE) ..... 198 47 482
Feb. 3, 1999 (DE) ..... 199 04 360
Feb. 12, 1999 (DE) ..... 199 05 828

(51) Int. Cl.[7] ..... F42B 6/04; F41B 5/00

(52) U.S. Cl. ..... 473/582; 473/583; 124/23.1; 124/86

(58) Field of Search ..... 124/23.1, 24.1, 124/44.5, 86, 88; 473/578, 582, 583, FOR 216, FOR 219, FOR 221

(56) References Cited

U.S. PATENT DOCUMENTS 2,087,445 A * 7/1937 Price
2,213,637 A * 9/1940 Osgood
2,265,564 A * 12/1941 Klopsteg ..... 473/582
3,110,336 A * 11/1963 Sukala ..... 473/582 X
3,228,690 A * 1/1966 Allen ..... 473/582 X
3,424,460 A * 1/1969 Simpson
3,672,677 A * 6/1972 Moore ..... 473/578
3,746,334 A * 7/1973 Stubblefield
4,266,781 A * 5/1981 Blue
4,829,974 A * 5/1989 Anderson
4,946,172 A * 8/1990 Wong
4,958,617 A * 9/1990 Anderson ..... 124/24.1
5,112,062 A * 5/1992 Pratt
5,311,855 A * 5/1994 Basik ..... 124/44.5
5,842,942 A * 12/1998 Doht et al. ..... 473/578
6,142,895 A * 11/2000 Jason ..... 473/578 X

* cited by examiner

*Primary Examiner*—John A. Ricci
(74) *Attorney, Agent, or Firm*—Crowell & Moring, LLP

(57) ABSTRACT

An arrow for a bow or crossbow whose point is fitted with a capsule that can be pushed on before shooting. When the arrow is pulled out of a solid object, the capsule remains stuck in the object so that the arrow can be reused again undamaged. A hemispherical shaped flight stabilizer as viewed from the front is mounted on the forward area of a hunting point. During flight, the influence of side winds on the arrow is eliminated and thus an accurate shot is always made possible. The flight stabilizer consists of a material that can be easily destroyed when it strikes the target and is preferably in the form of a sphere that can have indentations on its surface. The shaft of a crossbow dr bow is fitted with members easily reached by the shooter, so that the point of is the arrow can be inserted exactly into the center of the spherical flight stabilizer.

13 Claims, 4 Drawing Sheets

ARROW FOR A CROSSBOW OR BOW

This application is a divisional of application Ser. No. 09/372,987, filed Aug. 12, 1999, now U.S. Pat. No. 6,203, 456.

FIELD OF INVENTION

The invention relates to an arrow for a crossbow or bow, which is provided with a novel point structure which, on striking a target, for example a shooting target, penetrates the target, and enables retrieval of the arrow. The invention also relates to a flight stabilizer for a hunting arrow and to a method for mounting the stabilizer on the arrow.

BACKGROUND OF THE INVENTION

Arrows of a great many different designs are known both for use during hunting and also when shooting at targets. They all suffer from the disadvantage that they penetrate the target and often cannot be rescued intact, since they break off when an attempt is made to pull them out. Practice or archery targets are thus manufactured at considerable expense from straw or similar material and, therefore, are very expensive in order to make it possible to pull the arrows out of the target undamaged.

In both archery and hunting, arrows frequently strike harder objects, for example tree trunks, and remain stuck fast in the tree, board, or the like. It is then impossible to pull them out intact, so that the entire expensive arrow is lost and cannot be used again.

The use of hunting arrows is known in many countries. In one form, the arrows have replaceable hunting points on the tip that are provided with sharp blades. When using such a hunting arrow, an accurate shot has so far not been possible except in absolute calm. Any side winds experienced during flight appear to press on the relatively large knife blades and can abruptly change the flight path of the arrow considerably. The result is a miss, usually associated with the loss of the expensive arrow. In addition, there is a considerable problem in that persons participating in the hunt can put themselves at considerable mortal danger from such a stray arrow. It often happens when such shots occur that the animal, if struck, is only injured and dies in agony.

A second major problem is that it is not possible to shoot accurately with a hunting arrow. For this purpose, archery= arrows are used that are fired at a target to gain information about aiming and flight. However, since hunting arrows have so far exhibited a completely different behavior in flight, it is practically impossible to shoot a crossbow exactly with the correct adjustment of a sight to determine the correct position of the bow or a harpoon or arrow for a certain range. Inaccurate shots, serious danger to hunters, and agonizing death of game are the result. Protests from animal rights organizations for these reasons are understandable.

SUMMARY OF THE INVENTION

The goal of the present invention is to make it possible to pull out arrows, along with the points, without the points being damaged. At the same time, the advance according to this invention makes it possible to use targets made of wood that are much simpler, and, hence, less expensive.

The present invention provides an arrow having a novel point structure comprising the point provided with a capsule that can be slid onto it and encloses it. When the arrow penetrates the target, the capsule forms the firing channel and remains deep in the target or in the object which it has struck. The point of the arrow is pulled out easily undamaged from the capsule, which remains stuck in the target. After a new capsule has been slid on, the arrow can be used again.

In order to keep the capsule from sliding spontaneously and inadvertently off the point after being slid on, provision is made according to the invention that easily releasable clamping fastening, for example by an elastic ring, is provided between the capsule and the arrow point.

Since, in accordance with the advance according to the invention as described above, the arrow point can be pulled out undamaged even from solid materials with only the loss of a small capsule, there is nothing to prevent the target according to the invention being made quite simply out of wood. A wooden target can be manufactured very economically and simply and is by no means as expensive as known targets made of straw or the like. As a result, the expenses associated with target shooting are considerably reduced so that this sport can be made accessible to a wider public.

In a further aspect of the invention, a flight stabilizer is provided. Extensive testing has resulted in the elimination of the aforementioned problems, with a flight stabilizer being created that consists of a material, plastic for example, that is easily destroyed when it strikes the target, and has an opening in the front for mounting on the hunting point, and is made hemispherical at the front (as viewed in the flight direction).

As a result of the hemispherical shape, an air flow along the hunting point is produced that is so strong and uniform that the arrow is not deflected during flight by side winds, not even by strong wind gusts, so that an accurate shot is always guaranteed. With an arrow fitted with an archery point of the same weight and with the flight stabilizer mounted on it, the weapon can be fired at certain distances from a target. For use in hunting, the flight stabilizer is then pushed onto the front of the hunting point with the aid of the existing opening. When the arrow strikes the game, the knives on the hunting point destroy the flight stabilizer without a considerable loss of energy and then penetrate unimpeded into the animal to be shot, killing it on the spot.

The invention also provides that the flight stabilizer preferably consists of a sphere that can be mounted on the hunting point.

The same effect is achieved if the flight stabilizer tapers toward the rear like a drop.

Many empirical tests with practically all of the hunting points that are commercially available have shown that the greatest stabilizing effect is produced when the hemisphere has a diameter between 20 mm and 25 mm. If the diameter is greater than 25 mm, the effect of side winds on the stabilizer is greater than the effect of the stabilizing flow and if the diameter is less than 20 mm, the stabilizing effect is not sufficient to keep the arrow precisely on the desired path with side winds.

Also, the invention provides that the surface of the flight stabilizer has regularly distributed indentations. A surface with such a profile, known for example from golf balls, serves only for stabilization of the flight path.

When a spherical flight stabilizer is to be pushed onto the hunting point, it has proven to be especially difficult in practice to push the sphere onto the hunting point precisely through the center. If the sphere is off center on the arrow, misses cannot be avoided. With respect to the above-discussed difficulty in practice of pushing the sphere onto the hunting point precisely, this problem is avoided by the invention in a simple and novel fashion. The invention provides that a support for the arrow be provided, preferably laterally on the shaft of the crossbow or bow, on whose extension a cylindrical receptacle for the spherical flight stabilizer is located. The arrow is placed on the support and the sphere is placed in the receptacle. By axially shifting the arrow, the hunting point strikes the sphere precisely in the center and penetrates it. The sphere is thus pierced exactly through the center. Then the arrow together with the sphere is removed from the support and then placed in the crossbow or bow for shooting. The device could also be utilized separately from the crossbow or bow on an independent support.

For simplicity of the design, the support is composed of two half shells matching the diameter of the arrow shaft, said shells being located one behind the other parallel to the shaft.

The receptacle for the spherical flight stabilizer is formed according to the invention by a cylinder located on an extension of the support, with the inside diameter of the sphere matching the outside diameter of the spherical flight stabilizer. An annular plug or internal flange with a central opening can be fixedly mounted at the end of the cylinder remote from the arrow to hold the stabilizer stationary while being penetrated by the arrow.

The invention, in all of its aspects, and as characterized in the claims, will now be described in greater detail.

BRIEF DESCRIPTION OF THE DRAWINGS

FIG. 1 shows an arrow according to the invention with the novel, inventive capsule pushed on.

DETAILED DESCRIPTION OF THE PREFERRED EMBODIMENTS

Figure 1:
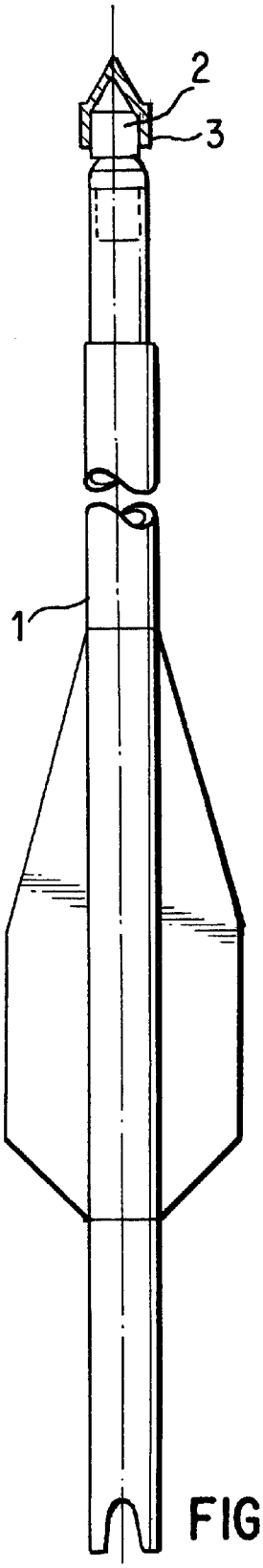
Figure 2:
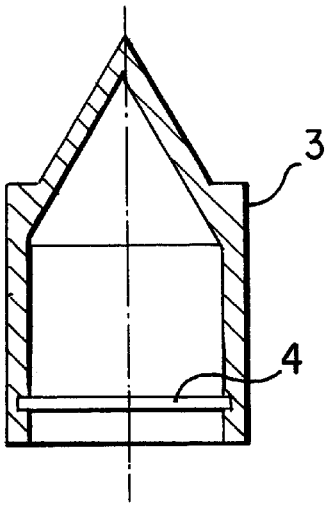
FIG. 2 shows the novel and inventive capsule on an enlarged scale.

Referring initially to FIGS. 1 and 2, arrow 1 has a screwed-on point 2 onto which a matching capsule 3 is pushed. In order to keep capsule 3 from sliding inadvertently off arrow point 2, a rubber ring is provided as clamp 4.

If the arrow point 2 penetrates a solid object, for example a tree trunk, arrow 1 with point 2 can be pulled out of capsule 3 without either arrow 1 or point 2 being damaged, and thus out of the tree trunk. Capsule 3 remains stuck in the tree. Then a new capsule 3 is pushed onto point 2 so that arrow 1 can be used again.

Figure 3:
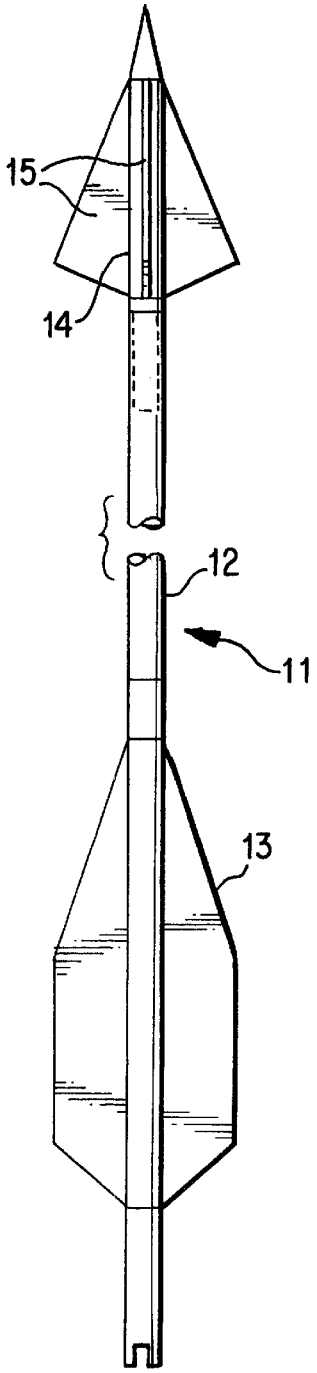
FIG. 3 shows a hunting arrow and stabilizer according to the invention, with the novel flight stabilizer not yet mounted.
Figure 3A:
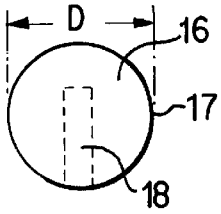
Figure 4:
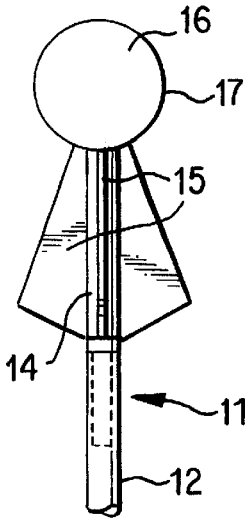
FIG. 4 shows the hunting arrow of FIG. 3, with the novel flight stabilizer mounted.
Figure 5:
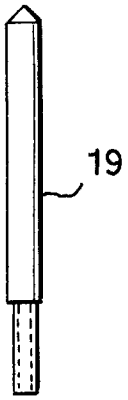
FIG. 5 shows a point of an archery arrow replacing the hunting point shown in FIGS. 3 and 4, and on which the novel stabilizer can be mounted.

Referring now to FIGS. 3–5, the novel stabilizer will be described. Hunting arrow 11 consists of a shaft 12 with control surfaces 13 and a hunting point 14 that can be screwed on, said point 14 being fitted with sharp knife blades 15. The novel flight stabilizer 16 consists of material such as plastic that can be very easily destroyed. Stabilizer 16 is in the form of a sphere 17, and is pushed from the front onto hunting point 14 with the aid of opening or partial bore 18 already provided or preformed. Hunting arrow 11 is thus prepared for shooting, as seen in FIG. 4. The front hemisphere of the flight stabilizer 16, and hence, in this case the sphere 16, has a diameter D between 20 mm and 25 mm.

As a replacement for hunting point 14, an archery point 19 is screwed in place for shooting the arrow weapon, onto which point 19 a flight stabilizer 16 is then mounted. At the desired firing distance, the weapon can then be shot accurately at a target.

Figure 6:
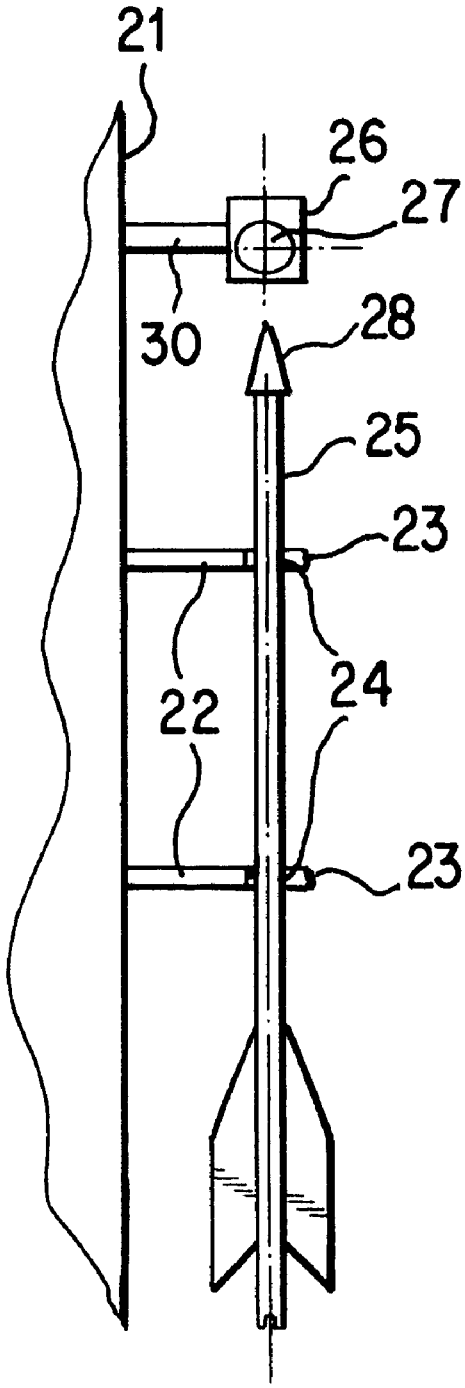
FIG. 6 shows a crossbow modified for carrying out the method for precisely locating the novel stabilizer on the hunting point of an arrow.

Referring now to FIG. 6, the novel structure and method for pushing the novel stabilizer onto the hunting arrow is described, and the novel method is explained. Two tabs 22 with half shells 23 are mounted laterally on the shaft 21 of a crossbow, not described herein in greater detail, said shells 23 forming support 24 for the arrow 25. The inner diameter of the half shells 23 matches the outer diameter of the shaft of arrow 25.

A cylindrical receptacle 26 for the spherical flight stabilizer 27 is likewise mounted on shaft 21 laterally on an extension 30 which is spaced axially from the support 24. A stabilizer 27 like stabilizer 16 is placed in receptacle 26 that is shaped to enable stabilizer 27 to be introduced into and held in receptacle 26. Then the arrow 25 is placed on support 24 and pushed axially forward so that the point 28 of the arrow penetrates exactly through the middle of flight stabilizer 27 and thus transfixes it. Arrow 25 can then be pulled out of the receptacle 26 with the flight stabilizer 27 and removed from support 24 in order to place it in the crossbow or bow and to shoot it.

Figure 7:
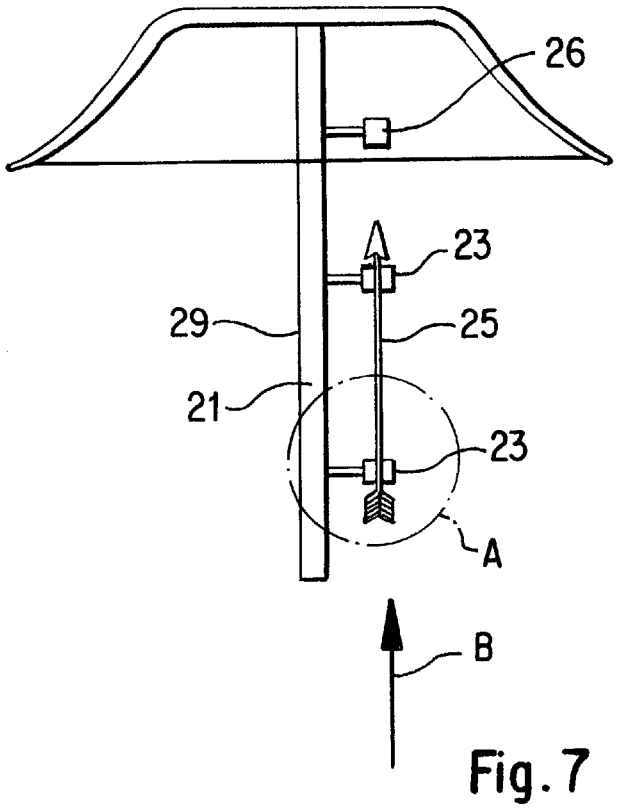
FIG. 7 is a view from the top of a crossbow with a seat for an arrow.
Figure 8:
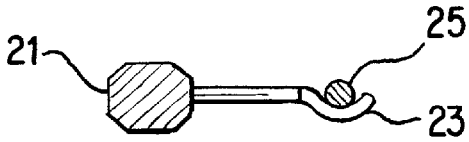
FIG. 8 is a cross-sectional view of portion A as seem in the direction B.

FIG. 7 is a view similar to FIG. 6 and shows the half shells 23 as well as the receptacle 26 fastened on the shaft 21 of a crossbow 29. As FIG. 8 illustrates, the arrow 25 is placed on the half shells 23 and thus is placed in an exact position for seating the flight stabilizer in the receptacle 26.

Figure 9:
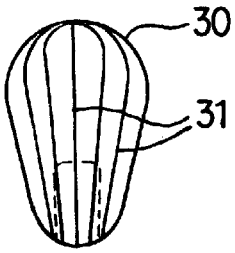
FIG. 9 shows a drop shaped first stabilizer.

The flight stabilizer 30 shown in FIG. 9 has a drop shape and has small regularly distributed surface indentations 31.

Alternatively, the device can be made separate from the crossbow by using a base in place of the crossbow, and mounting the stabilizer holder and arrow holder on the base.

Although the present invention has been shown and described in terms of specific preferred embodiments, nevertheless, changes and modifications are possible, such as will occur to those skilled in the art, which do not depart from the techniques of the present invention. Such changes and modifications are deemed to fall within the purview of the invention as claimed.

What is claimed is:

1. The combination of a flight stabilizer and a hunting arrow, which is to be fired from a crossbow or bow and provided with a hunting point, wherein the stabilizer comprises a body consisting of a material that will be readily destroyed when it strikes the target, said body having an opening for mounting on the front of the hunting point and being designed to be hemispherical, as viewed from the front in the flight direction.

2. The combination according to claim 1, wherein the flight stabilizer is plastic.

3. The combination according to claim 1 wherein the flight stabilizer is a sphere.

4. The combination according to claim 1, wherein the flight stabilizer tapers toward the rear like a drop.

5. The combination according to claim 1, wherein the flight stabilizer defines at least a hemisphere having a diameter between 20 mm and 25 mm.

6. The combination according to claim 1, wherein the flight stabilizer has small regularly distributed surface indentations.

7. The combination according to claim 1, wherein the hunting point is fitted with sharp blades to kill an animal to be shot.

8. A combination comprising a flight stabilizer formed as a portion of a sphere, an arrow and a crossbow or bow, a support for the arrow formed on the shaft of the crossbow or bow, with a receptacle for the flight stabilizer being provided on an extension of the crossbow or bow axially spaced from the support.

9. The combination of claim 8, wherein the support is formed by two half shells matching the diameter of the arrow shaft, said shells being arranged one behind the other parallel to the arrow shaft.

10. The combination of claim 8, wherein the receptacle is formed by a cylinder having an inside diameter matching the outside diameter of the flight stabilizer.

11. The combination of claim 8, wherein the flight stabilizer is spherical.

12. The combination of claim 8, wherein the flight stabilizer is drop shaped.

13. The method comprising:

a. mounting a flight stabilizer in the form of a portion of a sphere in a stationary position, b. mounting an arrow axially aligned with the center of the stabilizer with the point of the arrow pointing toward the flight stabilizer, and c. axially moving the arrow toward the flight stabilizer until the point of the arrow impales the flight stabilizer.

* * * * *